US006367251B1

(12) United States Patent
Wood

(10) Patent No.: US 6,367,251 B1
(45) Date of Patent: Apr. 9, 2002

(54) LOCKABLE MICROELECTROMECHANICAL ACTUATORS USING THERMOPLASTIC MATERIAL, AND METHODS OF OPERATING SAME

(75) Inventor: Robert L. Wood, Cary, NC (US)

(73) Assignee: JDS Uniphase Corporation, San Jose, CA (US)

( * ) Notice: Subject to any disclaimer, the term of this patent is extended or adjusted under 35 U.S.C. 154(b) by 0 days.

(21) Appl. No.: 09/543,540

(22) Filed: Apr. 5, 2000

(51) Int. Cl.[7] ..... F01B 29/10

(52) U.S. Cl. ..... 60/528; 60/527; 310/306; 310/307

(58) Field of Search ..... 60/528, 527; 310/306, 310/307, 309

(56) References Cited

U.S. PATENT DOCUMENTS

| | | | | |
|---|---|---|---|---|
| 4,203,086 A | | 5/1980 | Smith | 337/410 |
| 5,909,078 A | | 6/1999 | Wood et al. | 310/307 |
| 5,955,817 A | | 9/1999 | Dhuler et al. | 310/307 |
| 5,962,949 A | | 10/1999 | Dhuler et al. | 310/307 |
| 5,979,892 A | * | 11/1999 | Smith | 271/267 |
| 5,994,816 A | | 11/1999 | Dhuler et al. | 310/307 |
| 6,023,121 A | | 2/2000 | Dhuler et al. | 310/307 |
| 6,184,699 B1 | * | 2/2001 | Smith et al. | 324/762 |

OTHER PUBLICATIONS www.aremco.com, *Washaway Mounting Adhesives and Accessories*, Technical Bulletin A9.

European Search Report, Application No. 01302513.5, Jul. 27, 2001.

* cited by examiner

*Primary Examiner*—Hoang Nguyen
(74) *Attorney, Agent, or Firm*—Myers Bigel Sibley & Sajovec

(57) ABSTRACT

Lockable microelectromechanical actuators include a microelectromechanical actuator, a thermoplastic material that is coupled to the microelectromechanical actuator to lock the microelectromechanical actuator, and a heater that melts the thermoplastic material to allow movement of the microelectromechanical actuator. When the thermoplastic material solidifies, movement of the microelectromechanical actuator can be locked, without the need to maintain power, in the form of electrical, magnetic and/or electrostatic energy, to the microelectromechanical actuator, and without the need to rely on mechanical friction to hold the microelectromechanical actuator in place. Thus, the thermoplastic material can act as a glue to hold structures in a particular position without the need for continuous power application. Moreover, it has been found unexpectedly, that the thermoplastic material can solidify rapidly enough to lock the microelectromechanical actuator at or near its most recent position.

34 Claims, 5 Drawing Sheets

LOCKABLE MICROELECTROMECHANICAL ACTUATORS USING THERMOPLASTIC MATERIAL, AND METHODS OF OPERATING SAME

FIELD OF THE INVENTION

This invention relates to electromechanical systems, and more particularly to microelectromechanical systems and operating methods therefor.

BACKGROUND OF THE INVENTION

Microelectromechanical systems (MEMS) have been developed as alternatives to conventional electromechanical devices, such as relays, actuators, valves and sensors. MEMS devices are potentially low-cost devices, due to the use of microelectronic fabrication techniques. New functionality also may be provided, because MEMS devices can be much smaller than conventional electromechanical devices.

Many applications of MEMS technology use MEMS actuators. These actuators may use one or more beams that are fixed at one or both ends. These actuators may be actuated electrostatically, magnetically, thermally and/or using other forms of energy.

A major breakthrough in MEMS actuators is described in U.S. Pat. No. 5,909,078 entitled *Thermal Arched Beam Microelectromechanical Actuators* to the present inventor et al., the disclosure of which is hereby incorporated herein by reference. Disclosed is a family of thermal arched beam microelectromechanical actuators that include an arched beam which extends between spaced apart supports on a microelectronic substrate. The arched beam expands upon application of heat thereto. Means are provided for applying heat to the arched beam to cause further arching of the beam as a result of thermal expansion thereof, to thereby cause displacement of the arched beam.

Unexpectedly, when used as a microelectromechanical actuator, thermal expansion of the arched beam can create relatively large displacement and relatively large forces while consuming reasonable power. A coupler can be used to mechanically couple multiple arched beams. At least one compensating arched beam also can be included which is arched in a second direction opposite to the multiple arched beams and also is mechanically coupled to the coupler. The compensating arched beams can compensate for ambient temperature or other effects to allow for self-compensating actuators and sensors. Thermal arched beams can be used to provide actuators, relays, sensors, microvalves and other MEMS devices. Thermal arched beam microelectromechanical devices and associated fabrication methods also are described in U.S. Pat. No. 5,955,817 to Dhuler et al. entitled Thermal Arched Beam Microelectromechanical Switching Array; U.S. Pat. No. 5,962,949 to Dhuler et al. entitled Microelectromechanical Positioning Apparatus; U.S. Pat. No. 5,994,816 to Dhuler et al. entitled Thermal Arched Beam Microelectromechanical Devices and Associated Fabrication Methods; and U.S. Pat. No. 6,023,121 to Dhuler et al. entitled Thermal Arched Beam Microelectromechanical Structure, the disclosures of all of which are hereby incorporated herein by reference in their entirety.

Unfortunately, conventional MEMS actuators may require continuous application of an electrostatic potential, a magnetic field, electric current and/or other energy to the MEMS actuator in order to maintain the actuator in a set or actuated position. This may consume excessive power. Moreover, an interruption of power may cause the actuator to reset.

It is known to provide notches, dimples, protrusions, indentations and/or other mechanical features in MEMS actuators that can allow the actuator to be mechanically set in a given position. See for example, the above-cited U.S. Pat. Nos. 5,955,817 and 5,994,816. Unfortunately, these mechanical features may be subject to wear. Moreover, mechanical locking that relies on friction may be difficult to obtain reliably due to the small dimensions of MEMS actuators and the uncertain values of static and dynamic friction in MEMS devices. Thus, notwithstanding conventional microelectromechanical devices, there continues to be a need for lockable microelectromechanical actuators that need not consume power when locked and need not rely on mechanical friction for locking.

SUMMARY OF THE INVENTION

Lockable microelectromechanical actuators according to embodiments of the invention include a microelectromechanical actuator, a thermoplastic material that is coupled to the microelectromechanical actuator to lock the microelectromechanical actuator, and a heater that melts the thermoplastic material to allow movement of the microelectromechanical actuator. When the thermoplastic material solidifies, movement of the microelectromechanical actuator can be locked, without the need to maintain power, in the form of electric, magnetic and/or electrostatic energy, to the microelectromechanical actuator, and without the need to rely on mechanical friction to hold the microelectromechanical actuator in place. Thus, the thermoplastic material can act as a glue to hold structures in a particular position without the need for continuous power application. Moreover, it has been found unexpectedly, that the thermoplastic material can solidify rapidly enough to lock the microelectromechanical actuator at or near its most recent position.

Embodiments of the present invention preferably are formed on a substrate, wherein the heater is on the substrate and wherein a portion of the microelectromechanical actuator is adjacent and spaced apart from the heater, and wherein the thermoplastic material is between the heater and the portion of the microelectromechanical actuator. The microelectromechanical actuators may move along the substrate to provide embodiments of "in-plane" microelectromechanical actuators. Alternatively, the actuators may move out of the plane of the substrate, for example, orthogonal to the substrate, to provide embodiments of "out-of-plane" microelectromechanical actuators.

Embodiments of the present invention may be used with actuators that are actuated using electrostatic, magnetic, thermal and/or other forms of actuation. In embodiments of thermally actuated microelectromechanical actuators, the heater that melts the thermoplastic material also may be used to actuate the thermally actuated microelectromechanical actuator. In alternative embodiments, the heater that melts the thermoplastic material is a first heater and the lockable microelectromechanical actuator also includes a second heater that is thermally coupled to the microelectromechanical actuator, such that the microelectromechanical actuator moves in response to actuation of the second heater. Embodiments of lockable microelectromechanical actuators that employ first and second heaters also may include a thermal isolator that is configured to isolate the second heater from the thermoplastic material.

In embodiments of the present invention that use the same heater to melt the thermoplastic material and to actuate the thermal actuator, the heater may be configured to melt the thermoplastic material and actuate the thermal actuator upon application of a first amount of power thereto. The heater also may be configured to melt the thermoplastic material without actuating the thermal actuator upon application of second amount of power thereto that is less than the first amount of power. Unexpectedly, it has been found that the actuator can be restored to its starting or unactuated position by applying sufficient power to the heater to melt the thermoplastic material, but not enough power to actuate the actuator. With the thermoplastic material melted, viscous flow can occur and permit the actuator to relax back to its neutral position. Thus, a reversible system may be provided, that can allow continuous variability and simple control setup.

Thermoplastic materials according to the present invention may include thermoplastic polymers, thermoplastic monomers, solders and/or any other material that changes from a solid to a liquid material over a temperature range that is compatible with the ambient temperature in which the lockable microelectromechanical actuator will be used. Embodiments of lockable microelectromechanical actuators according to the invention may be combined with a relay contact, an optical attenuator, an optical switch, a variable circuit element such as a variable resistor, a valve, a circuit breaker and/or other elements to provide a microelectromechanical device.

Other embodiments of the invention provide lockable thermal arched beam microelectromechanical actuators. Embodiments of thermal arched beam microelectromechanical actuators include a substrate, spaced apart supports on the substrate and an arched beam that extends between the spaced apart supports, and that further arches upon application of heat thereto for movement along the substrate. A thermoplastic material is coupled to the arched beam to lock the arched beam. A heater melts the thermoplastic material to allow movement of the arched beam. In preferred embodiments, the heater is on the substrate, the arched beam is adjacent and spaced apart from the heater, and the thermoplastic material is between the heater and the arched beam.

Embodiments of lockable thermal arched beam microelectromechanical actuators use the heater both to further arch the arched beam and to melt the thermoplastic material. Alternative embodiments use a first heater to melt the thermoplastic material and a second heater that is thermally coupled to the arched beam to further arch the arched beam. These alternative embodiments also may include a thermal isolator that is configured to thermally isolate the second heater from the thermoplastic material.

As was described above, in embodiments of lockable thermal arched microelectromechanical actuators wherein a single heater is used, the heater may be configured to melt the thermoplastic material and to further arch the arched beam upon application of a first amount of power thereto. The heater also may be configured to melt the thermoplastic material without further arching the arched beam upon application of a second amount of power thereto that is less than the first amount of power. Embodiments of lockable thermal arched beam microelectromechanical actuators can use the thermoplastic materials selected that were described above, and can be combined with other elements as was described above.

Other embodiments of lockable thermal arched beam microelectromechanical actuators use first and second parallel arched beams that further arch upon application of heat thereto. A coupler is attached to the first and second arched beams, such that the first and second arched beams move in tandem along the substrate upon application of heat thereto. In these embodiments, the thermoplastic material may extend between the coupler and the heater. The coupler may include an aperture that extends therethrough from opposite the heater to adjacent the heater and that is configured to allow placement of the thermoplastic material between the coupler and the heater.

Microelectromechanical actuators may be operated, according to embodiments of the present invention, by melting a thermoplastic material that is coupled to the microelectromechanical actuator to unlock the microelectromechanical actuator. The unlocked microelectromechanical actuator may be actuated. The melted thermoplastic material then may be allowed to solidify to lock the microelectromechanical actuator. In embodiments of these methods, the melting and actuating may be performed simultaneously. In other embodiments, melting of the thermoplastic material is performed by applying power to a heater that is thermally coupled to the thermoplastic material. The melted material is solidified by removing the power from the heater.

In alternative embodiments of methods according to the present invention, the microelectromechanical actuator is a thermally actuated microelectromechanical actuator wherein the heater also is thermally coupled to the thermally actuated microelectromechanical actuator. Power is applied to the heater to actuate the thermally actuated microelectromechanical actuator. Melting and actuating may be performed simultaneously by applying power to the heater.

In alternate embodiments of methods according to the present invention wherein the microelectromechanical actuator includes a first heater that is thermally coupled to the thermoplastic material and includes a second heater that is thermally coupled to the thermally actuated microelectromechanical actuator, melting may be performed by applying power to the first heater to melt the thermoplastic material. Actuating may be performed by applying power to the second heater, to actuate the thermally actuated microelectromechanical actuator. Power then may be removed from the heater, to allow the melted thermoplastic material to solidify.

In all of the above method embodiments, the step of allowing the melted thermoplastic material to solidify may be followed by again melting the thermoplastic material to again unlock the microelectromechanical actuator. The microelectromechanical actuator then can return to its neutral or retracted position. Thus, by melting the thermoplastic material, the microelectromechanical actuator can be unlocked and deactuated.

In embodiments of the present invention wherein a single heater also is used to thermally actuate the microelectromechanical actuator, the step of again melting the thermoplastic material may be performed by applying power to the heater that is sufficient to melt the thermoplastic material, but is insufficient to actuate the thermally actuated microelectromechanical actuator. The actuator thereby can deactuate or retract. In alternative embodiments wherein first and second heaters are used as described above, the step of again melting the thermoplastic material may be embodied by applying power to the first heater to melt the thermoplastic material without applying power to the second heater.

Accordingly, lockable microelectromechanical actuators including lockable thermal arched beam microelectromechanical actuators, may be provided. These actuators need not consume power to remain actuated and need not rely on mechanical friction to maintain actuation. Thermoplastic materials also may be used to produce lockable large scale actuators that are not microelectromechanical actuators.

DETAILED DESCRIPTION OF PREFERRED EMBODIMENTS

Figure 1A:
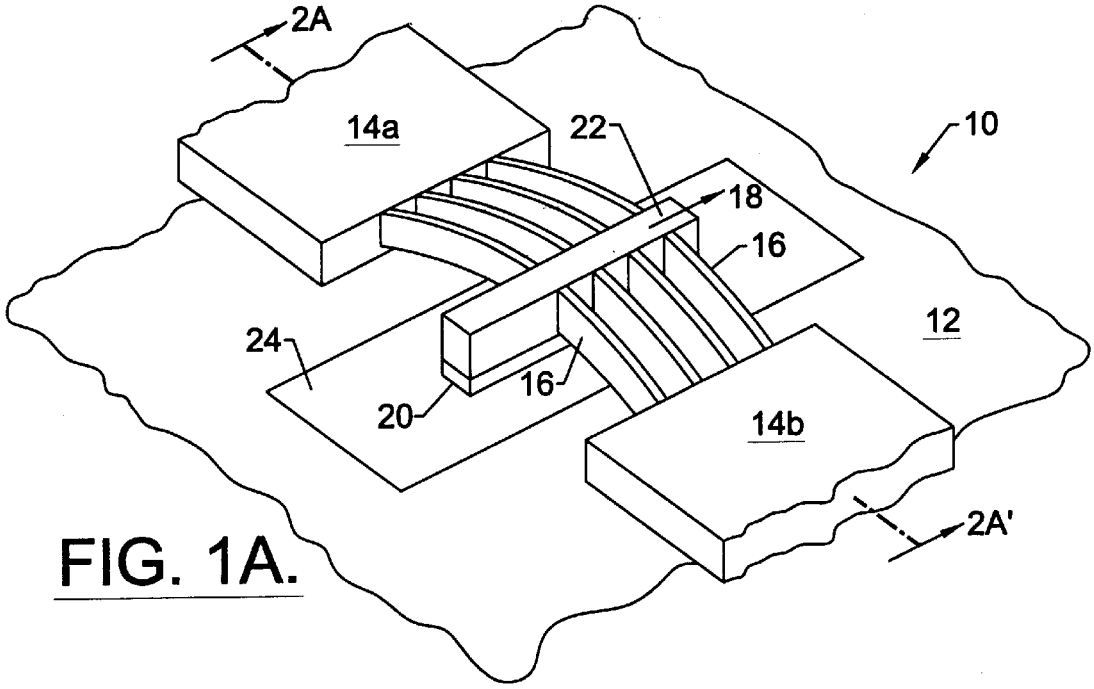
FIG. 1A is a perspective view of embodiments of lockable thermal arched beam microelectromechanical actuators according to the present invention in an unactuated position.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. It will be understood that when an element such as a layer, region or substrate is referred to as being "on", "connected to" or "coupled to" another element, it can be directly on, directly connected to or directly coupled to the other element, or intervening elements also may be present. In contrast, when an element is referred to as being "directly on", "directly connected to" or "directly coupled to" another element, there are no intervening elements present.

Figure 2A:
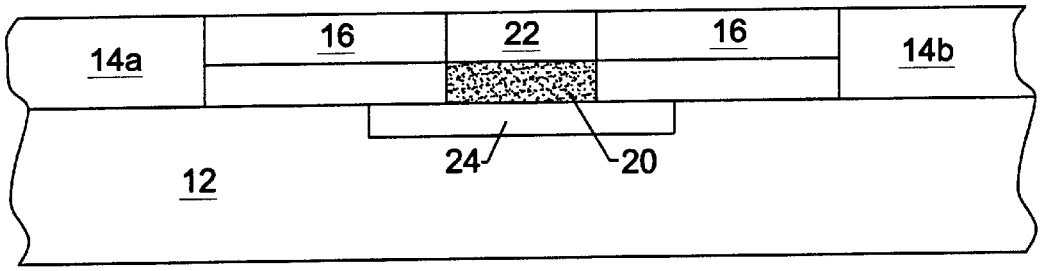
FIG. 2A is a side cross-sectional view along line 2A–2A' of FIG. 1A.

Referring now to FIGS. 1A and 2A, a perspective view and a side cross-sectional view along line 2A–2A' of first embodiments of lockable thermal arched beam microelectromechanical actuators according to the present invention in an unactuated, retracted or neutral position, are shown. As shown in FIGS. 1A and 2A, embodiments of lockable thermal arched microelectromechanical actuators 10 include a substrate 12, such as a silicon semiconductor substrate, spaced apart supports 14*a* and 14*b* on the substrate, and one or more arched beams 16 that extend between the spaced apart supports 14*a* and 14*b* and that further arch upon application of heat thereto in the direction shown by arrow 18 for movement along the substrate 12. It will be understood that a single arched beam 16 may be used. In alternative embodiments, a plurality of arched beams 16, such as four arched beams 16 in FIGS. 1A and 2A, may be used, that are coupled to common supports and/or individual supports. As used herein, any reference to a beam also shall include multiple beams, and any reference to multiple beams also shall include a single beam. A coupler may be attached to the arched beams 16, such that the arched beams 16 move in tandem along the substrate 12 upon application of heat thereto. As described in the above-cited U.S. Pat. Nos. 5,909,078, 5,955,817, 5,962,949, 5,994,816 and 6,023,121, heat may be applied to the arched beams 16 by passing current through the beams and/or by an external heater. The design and operation of thermal arched beams as described in this paragraph are well known to those having skill in the art and need not be described further herein.

Still referring to FIGS. 1A and 2A, a thermoplastic material 20 is coupled to the arched beam 16 to lock the arched beam. A heater 24 also is provided that melts the thermoplastic material, to allow movement of the arched beam. The heater 24 may be provided on the substrate 12 as illustrated. In other embodiments, the heater may be coupled to the arched beams 16 and/or the coupler 22, to move with movement of these elements.

In preferred embodiments illustrated in FIG. 1A, the heater 24 is on the substrate 12, and the arched beams 16 are adjacent and spaced apart from the heater. The thermoplastic material is between the heater and the arched beams 16. More preferably, as shown in FIG. 1A, the thermoplastic material is between the coupler 22 and the heater 24.

The thermoplastic material 20 may be formed between the coupler 22 and the heater 24 by forming the thermoplastic material 20 on the heater prior to forming the coupler 22 thereon. Alternatively, a solid thermoplastic material may be placed adjacent the gap (such as a 1 $\mu$m gap) between the heater 24 and the coupler 22 after fabrication of the coupler 22. The heater 24 then may be activated to melt the thermoplastic material 20, and allow it to creep between the heater 24 and coupler 22 by capillary action.

As is well known to those having skill in the art, a thermoplastic material becomes soft (liquid) when heated and hard (solid) when cooled. Thermoplastic materials also may be referred to herein as Phase-Change Materials (PCM). Many thermoplastic materials are known to those having skill in the art and may be used in embodiments of the present invention. For example, a thermoplastic polymer may be used. An example of a thermoplastic polymer that may be used is Crystalbond™ 509, marketed by Aremco Products, Inc., Valley Cottage, N.Y. As described in the Aremco Products web site, www.aremco.com, Crystalbond™ 509 is a washaway adhesive that may be used to temporarily mount products that require dicing, polishing and/or other machining processes. These adhesives can exhibit high bond strength and adhere readily to metals, glass and ceramics. Crystalbond™ 509 has a flow point of 250° F. (121° C.) and a viscosity of 6000 cps. Another example of a thermoplastic polymer that may be used is polyethylene glycol, which is widely available in various molecular weights. As is known to those having skill in the art, the melting temperature of polyethylene glycol can be a function of the molecular weight, so that a variety of melting points may be selected for various applications. Thermoplastic monomers also may be used.

The thermoplastic material preferably should be selected so that it remains in solid form in the range of ambient temperatures over which the microelectromechanical actuator may be used, yet can be melted at a temperature range that is slightly higher than the highest ambient temperature in which the microelectromechanical actuator may be used. The thermoplastic material preferably should melt over a narrow temperature range. The thermoplastic material also preferably should wet to the thermal arched beam 16 and/or the coupler 22 to which it is coupled. Thus, when the thermal arched beams and/or coupler are nickel, the thermoplastic material preferably should wet to nickel. The thermoplastic material also preferably should not wet to the heater 24 so that it can move with the thermal arched beam and/or coupler upon actuation thereof. Thus, when the heater 24 comprises polysilicon, the thermoplastic material preferably should not wet to polysilicon.

In higher temperature embodiments, solder may be used as a thermoplastic material 20. For example, conventional lead-tin eutectic solder may have a melting point of about 240° C. Other thermoplastic materials may be used, depending upon the ambient temperature, the materials associated with the microelectromechanical actuator, and/or other factors.

Referring again to FIGS. 1A and 2A, embodiments of lockable arched beam microelectromechanical actuators are shown in their unactuated, neutral, return or retracted position. In this position, the thermoplastic material 20 preferably is maintained in solid form by not applying heat thereto from heater 24. Thus, chatter or other movement of the actuator 10 may be prevented.

Figure 1B:
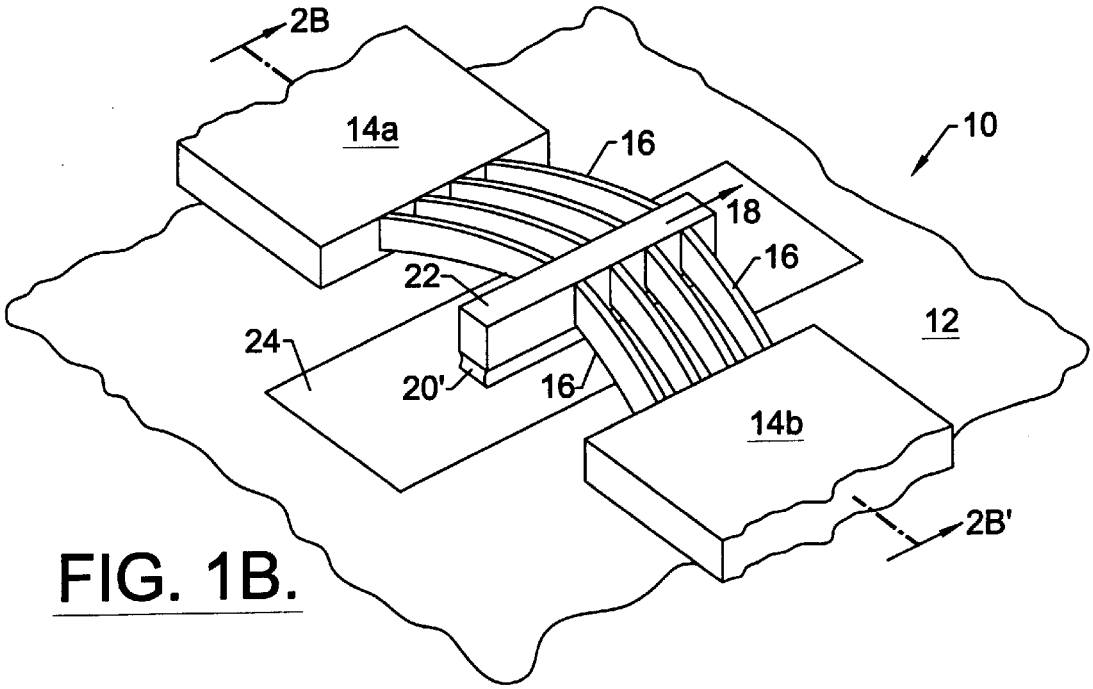
FIG. 1B is a perspective view of embodiments of lockable thermal arched beam microelectromechanical actuators according to the present invention in an actuated position.
Figure 2B:
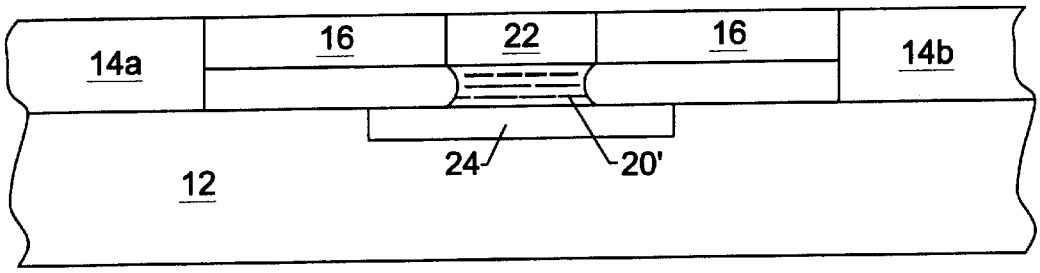
FIG. 2B is a side cross-sectional view along line 2B–2B' of FIG. 1B.

FIGS. 1B and 2B are a perspective view and a side cross-sectional view along the lines 2B–2B', of embodiments of lockable arched beam microelectromechanical actuators in a locked and actuated position. In order to actuate actuators of FIGS. 1A and 2A into the actuated position of FIGS. 1B and 2B, sufficient heat is applied to heater 24 to melt the thermoplastic material 20. Sufficient heat also is applied to thermal arched beams 16, to further arch the beams 16 in the direction 18 for movement along the substrate 12. This heat may be applied using heater 24, using another external heater and/or by passing current through the beams 16 themselves. The melted or plastic form of the thermoplastic material is designated 20' in FIGS. 1B and 2B, and is illustrated with a meniscus that is typical of a liquid material that is coupled between the surfaces of the coupler 22 and the heater 24.

Upon removal of power from the heater 24 while the actuator is actuated in the position shown in FIGS. 1B and 2B, the thermoplastic material solidifies, thus maintaining the actuator at or near its actuated position shown in FIGS. 1B and 2B. Thus, notwithstanding removal of power from the heater 24, from an external heater and/or termination of the current in the beam or beams 16, the actuator may remain at or near its actuated position.

Still referring to FIGS. 1A, 1B, 2A and 2B, when a single heater 24 is used to both actuate the thermal arched beam microelectromechanical actuator and to melt the thermoplastic material 20, unexpected results may be obtained. A first unexpected result is that when power is removed from the heater, the thermoplastic material can solidify fast enough to lock the actuator in the actuated position shown in FIGS. 1B and 2B. A small amount of retraction may take place, but the thermoplastic material solidifies quickly enough so that the actuator remains at or near its most recent position shown in FIGS. 1B and 2B. In other to reduce or eliminate this small amount of retraction, current may be passed through a subset of the thermal arched beams in order to retain the thermal arched beams in the actuated position while the thermoplastic material solidifies.

Another unexpected result is that the actuator can be returned to or near its unactuated or neutral position of FIGS. 1A and 2A from its actuated position of FIGS. 1B and 2B, by applying sufficient heater current to heater 24 to melt the thermoplastic material, but not enough current to thermally actuate the actuator. Thus, the heater 24 may be configured to melt the thermoplastic material 20 and actuate the thermal arched beam upon application of a first amount of power thereto, and to melt the thermoplastic material without actuating the thermal arched beam upon application of a second amount of power thereto that is less than the first amount of power.

In specific embodiments, it has been found that six volts and 25 mA may be applied to a heater 24 for 10 ms to melt the thermoplastic material 20 and to actuate the actuator 10. Upon removal of this power, the thermoplastic material solidifies so that the actuator remains in its actuated position. Continuing with this embodiment, to reset the actuator, 15 mA may be applied to the heater 24 at 4V for about 15 ms. This power is sufficient to melt the thermoplastic material 20, but is insufficient to cause the thermal arched beam to remain actuated. Thus, the actuator may be restored. Upon removal of this power, the actuator may be maintained in its restored position when the thermoplastic material solidifies.

Figure 3A:
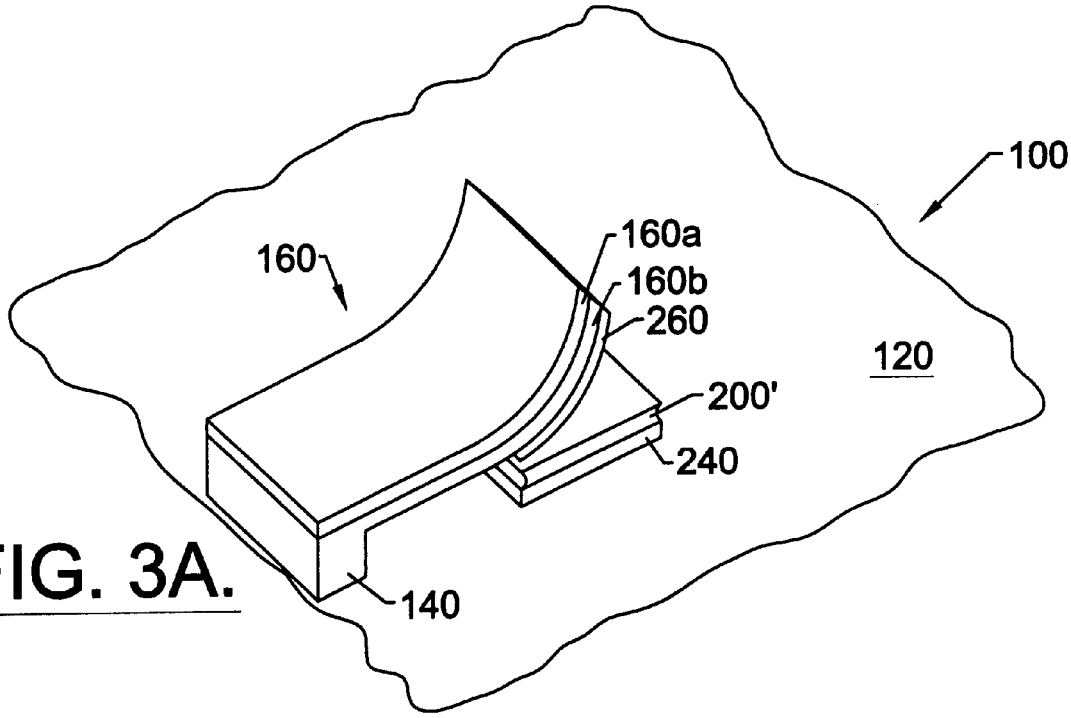
FIG. 3A is a perspective view of other embodiments of lockable microelectromechanical actuators according to the present invention in an unlocked and open position.
Figure 3B:
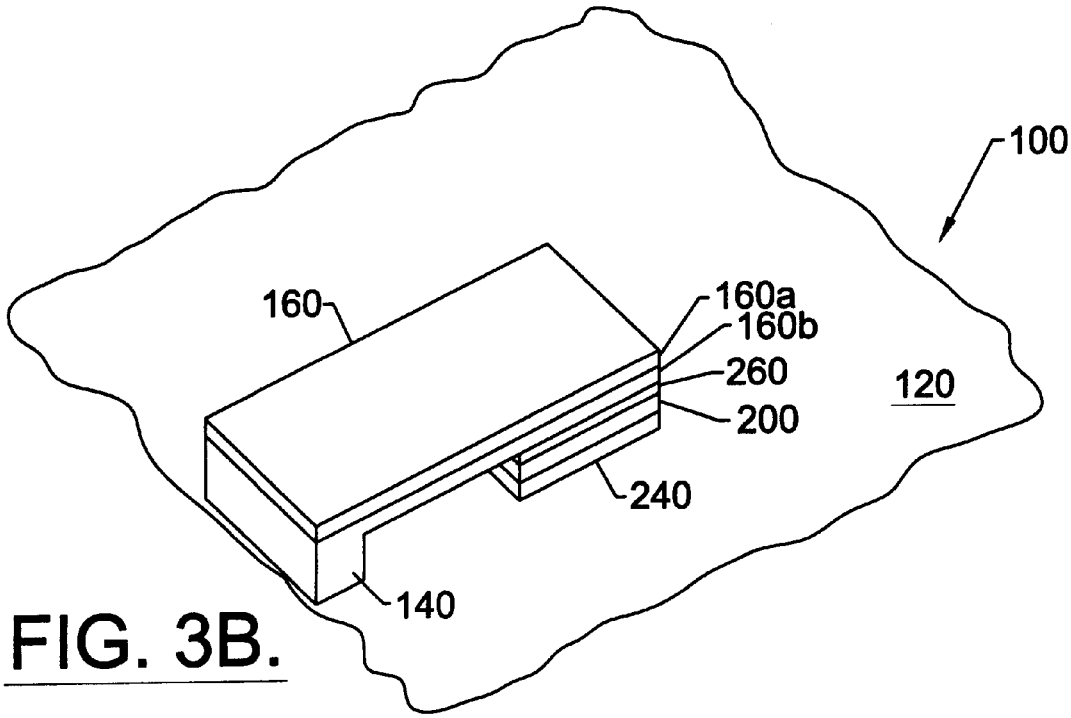
FIG. 3B is a perspective view of other embodiments of lockable nmicroelectromechanical actuators according to the present invention in a locked and closed position.

FIGS. 3A and 3B illustrate alternate embodiments of lockable microelectromechanical actuators according to the present invention. These embodiments illustrate lockable, out-of-plane, bimorph, cantilever thermal microelectromechanical actuators. It also will be understood that other microelectromechanical actuators including thermal, magnetic, electrostatic, in-plane and/or out-of-plane actuators may be provided.

FIG. 3A is a perspective view illustrating embodiments of bimorph cantilever actuators in an unlocked and open position and FIG. 3B illustrates embodiments of bimorph cantilever beam thermal actuators in a locked and closed position. Referring to FIG. 3A, these embodiments of lockable thermal actuators 100 include a substrate 120, such as a silicon semiconductor substrate, a support 140 and a cantilever beam 160 that comprises two bimorph materials 160*a* and 160*b*. The bimorph materials 160*a* and 160*b* are configured such that when the bimorph cantilever beam 160 is not heated, it remains in the open position shown in FIG. 3A. A heater 240 may be provided to melt a thermoplastic material. The melted thermoplastic material is indicated in FIG. 3A by 200'. Thus, upon application of heat to the heater 240, the thermoplastic material 200' melts, and the cantilevered beam 160 is allowed to retract to its retracted or neutral position shown in FIG. 3A.

Referring now to FIG. 3B, the cantilevered bimorph beam 160 is actuated by heating the cantilevered bimorph beam 160, for example by passing current therethrough and/or by using an external heater. Power then is removed from the heater 240, to allow the thermoplastic material 200 to solidify, thereby locking the bimorph cantilever beam 160 in its actuated position of FIG. 3B. Simultaneously, or thereafter, heating of the cantilever bimorph beam 160*b* may be terminated, so that no additional power need be consumed. It may be desirable to provide a thermal isolator 260 between the cantilever bimorph beam and the thermoplastic material 200, to thermally isolate the heated bimorph beam 160 from the heater 240. Thus, when power is removed from the heater 240, the heating of the beam 160 will not allow the thermoplastic material 200 to stay melted, but rather will allow the thermoplastic material 200 to solidify. Thermal isolators 260 may comprise silicon dioxide, silicon nitride and/or other materials with relatively low thermal conductivity. Other thermal isolator structures also may be provided.

Figure 4:
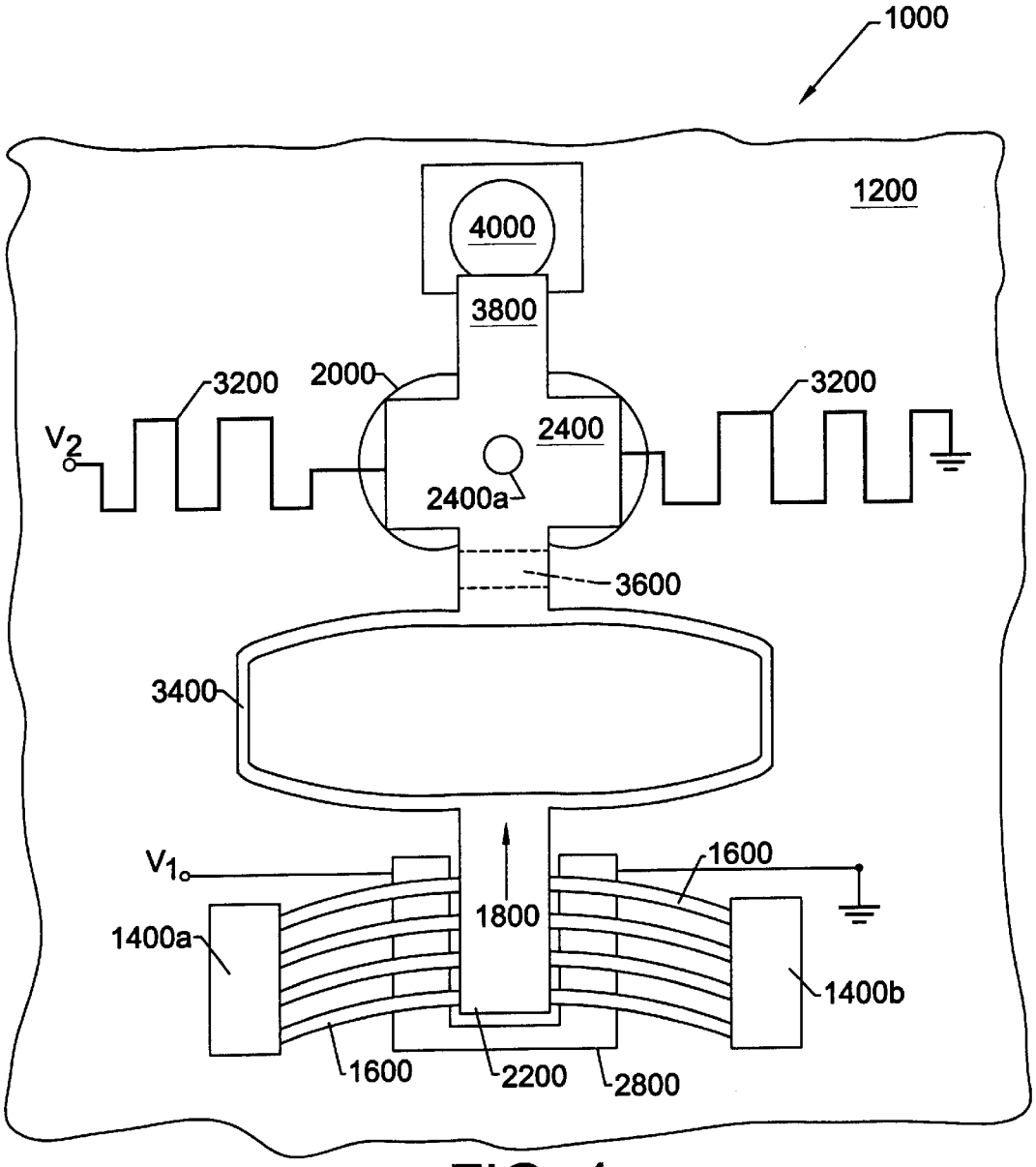
FIG. 4 is a top view of other embodiments of the lockable thermal arched beam microelectromechanical actuators according to the present invention.

FIG. 4 is a top view of other embodiments of lockable thermal arched beam microelectromechanical actuators according to the present invention. These embodiments employ separate heaters to actuate the thermal actuator and to melt the thermoplastic material. By providing separate heaters, more accurate positioning of an actuator may be obtained.

As shown in FIG. 4, these embodiments of lockable thermal arched beam microelectromechanical actuators 1000 include a substrate 1200, such as a silicon semiconductor substrate, spaced apart supports 1400*a* and 1400*b* on the substrate, and one or more arched beams 1600 that extend between the spaced apart supports 1400*a* and 1400*b* and that further arch upon application of heat thereto, for movement along the substrate in the direction shown by arrow 1800. In FIG. 4, multiple arched beams 1600 are coupled via a coupler 2200. The thermal arched beams 1600 are heated by application of a voltage $V_1$ across a pair of terminals that are coupled to a heater 2800.

Another heater 2400 may be mechanically coupled to the coupling member 2200, so that it moves along with the coupling member 2200. The heater 2400 will be referred to herein as a first heater and the heater 2800 will be referred to herein as a second heater. A second voltage $V_2$ may be applied across the first heater 2400 using flexible wires 3200. The flexible wires 3200 also may provide mechanical stability for the actuator. In alternative embodiments, the first heater 2400 may be directly on He the substrate and need not move with the actuator.

A thermoplastic material 2000 is provided between the heater 2400 and the substrate 1200. Upon application of a voltage $V_2$ between the flexible wires 3200, the thermoplastic material may be melted. An aperture 2400*a* may be provided in the heater 2400, to allow the thermoplastic material to be placed between the heater 2400 and the substrate 1200, by heating the heater 2400 and allowing the thermoplastic material to flow through the aperture 2400*a*, to between the heater 2400 and the substrate 1200 by capillary action. In alternative fabrication methods, the thermoplastic material 2000 may be fabricated on the substrate 1200 prior to fabricating the beams 1600, coupling member 2200 and heater 2400 above the substrate.

Still referring to FIG. 4, an isolation member 3400 also may be provided. The isolation member 3400 can act as a mechanical shock absorber, and also can thermally isolate the first heater 2400 from the second heater 2200, to allow independent control thereof. In alternative embodiments, thermal isolation or additional thermal isolation may be provided by a low thermal conductivity member 3600 that is placed between the first heater 2400 and the second heater 2800. The low thermal conductivity member 3600 may comprise, for example, silicon dioxide and/or silicon nitride. Other thermal and/or mechanical isolators may be provided.

Since two separate heaters 2400 and 2800 are employed in embodiments of FIG. 4, separate control of the melting of thermoplastic material 2000 and actuation of the thermal arched beams 1600 may be provided. Precise positioning of a movable member 3800 thereby may be provided. For example, as shown in FIG. 4, an optical fiber and/or an aperture 4000 may be coupled to and/or formed in the substrate 1200. Precise positioning of movable member 3800 over the aperture/fiber 4000 may be provided, to thereby provide precise metering of a fluid and/or precise attenuation of optical energy.

In particular, a variable voltage $V_1$ may be applied to the second heater 2800, to position the movable member 3800 while also applying sufficient voltage $V_2$ to the heater 2400 to melt the thermoplastic material 2000. Then, when a desired position is obtained, the voltage $V_2$ may be withdrawn so that the thermoplastic material 2000 solidifies. The voltage $V_1$ then may be withdrawn from the heater 2800. Thus, retraction of the movable member 3800 may be prevented so that precise positioning may be obtained in a variable position device. It will be understood that the movable member also may be coupled to relay contacts, variable circuit elements such as variable resistors, capacitors and/or inductors, temperature reactive devices such as circuit breakers and/or other elements for actuation and positioning by embodiments of microelectromechanical actuators according to the present invention.

Figure 5:
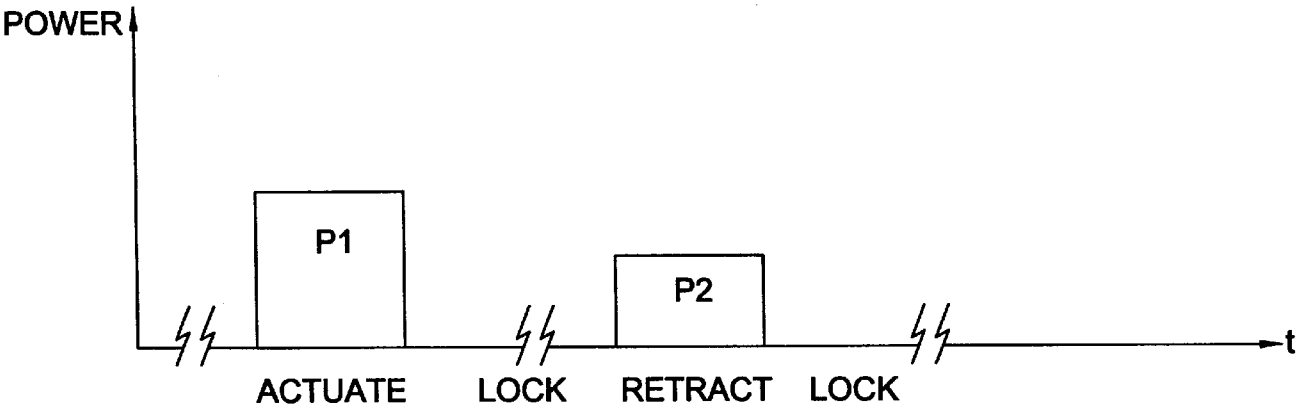
FIGS. 5, 6A and 6B are timing diagrams that illustrate embodiments of actuation, retraction and locking of microelectromechanical actuators according to the present invention
Figure 6A:
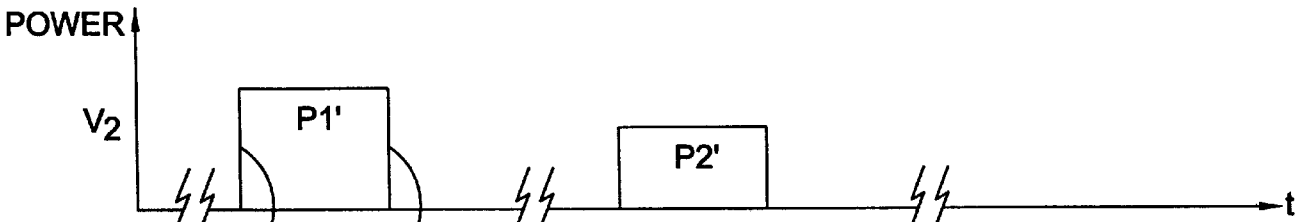
Figure 6B:
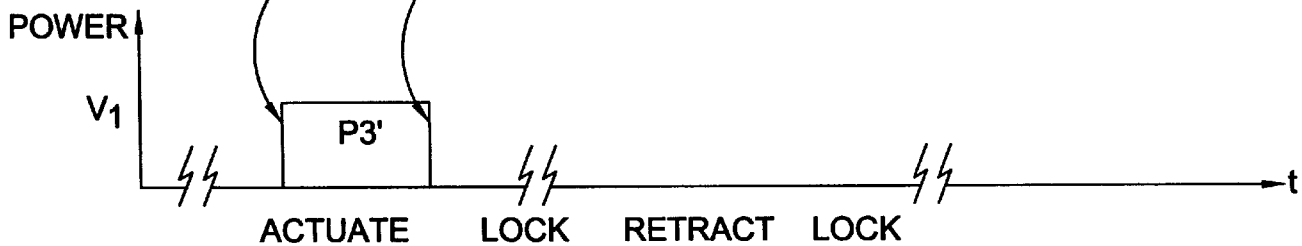

Referring now to FIGS. 5, 6A and 6B, embodiments of methods of operating microelectromechanical actuators according to the present invention now will be described. In general, method embodiments of the present invention melt a thermoplastic material that is coupled to a microelectromechanical actuator to unlock the microelectromechanical actuator, and actuate the unlocked microelectromechanical actuator. Melting and actuating may take place simultaneously. The melted thermoplastic material then is allowed to solidify to lock the microelectromechanical actuator in an actuated position. The thermoplastic material then may be melted again to unlock and deactuate the microelectromechanical actuator.

FIG. 5 is a timing diagram that illustrates actuation, retraction and locking of microelectromechanical actuators that use a single heater, such as embodiments of FIGS. 1A–2B. As shown in FIG. 5, in order to actuate the heater, a first pulse P1 of a first power is applied to the heater 24. The power of pulse P1 preferably is sufficient to melt the thermoplastic material 20 and to actuate thermal arched beam 16. For example, a pulse P1 of 25 mA at 6 V for 10 ms may be applied. Thus, melting of the thermoplastic material 20 and actuation of the thermal arched beam 16 may occur simultaneously. Thereafter, to lock the actuator in the actuated position, the pulse P1 is terminated. The thermoplastic material solidifies and acts like a glue. As was described above, a small amount of retraction may take place until the thermoplastic material solidifies.

Continuing with the description of FIG. 5, in order to retract the actuator, a second pulse P2 is applied that is of lower power than the first pulse P1. For example, 15 mA at 4V for 15 ms may be applied. Preferably, pulse P2 has power that is sufficiently high to melt the thermoplastic material 20, but is sufficiently low to prevent actuation of the actuator. Upon removal of the lower power pulse P2, the actuator is locked in the retracted position.

A surprising and unexpected result is that when power is removed from the heater by terminating pulse P1, the thermoplastic material solidifies fast enough to lock the actuator in its new position. A further unexpected result is that the actuator can be restored to its starting position by applying the pulse P2 that has enough heater power to melt the thermoplastic material but not enough to move the actuator. With the thermoplastic material melted, viscous flow can occur and permit the actuator to relax back to its neutral position.

The time scale for the phase change transitions has been found to be compatible with the mechanical response of thermal arched beam microelectromechanical actuators. This can provide a reversible system with continuous variability and allow a relatively simple control setup. Latching and unlatching may be accomplished by high and low power signals P1 and P1 respectively, across the same control inputs. Bistable operation thus may be achieved while allowing a simple control scheme. Reliability of at least 20,000 switch cycles presently has been obtained during testing, without degradation in electrical performance. Other thermoplastic materials may be selected to tailor the specific phase change temperature and the viscosity of the liquid phase according to device requirements.

FIGS. 6A and 6B are timing diagrams illustrating methods of operating microelectromechanical actuators that employ first and second heaters, such as the embodiments of FIG. 4. As shown in FIGS. 6A and 6B, in order to actuate the actuator, a voltage pulse P1' is applied to terminal $V_2$, to melt the thermoplastic material 2000. After the thermoplastic material 2000 is melted, a pulse P3' is applied to terminal $V_1$ to actuate the actuator to a desired position. When the actuator has reached its desired position, the pulse P1' is terminated, to thereby solidify the thermoplastic material 2000. The pulse P3' then may be terminated. It will be understood that since the pulses P1' and P3' are applied to separate heaters via separate terminals $V_2$ and $V_1$, the pulses P1' and P3' may include a wide range of voltage, current and/or time parameters that need not be related to one another.

Continuing with the description of FIGS. 6A and 6B, in order to retract the actuator, a second pulse P2' may be applied to terminal $V_2$, to again melt the thermoplastic material 2000. This pulse may have a different voltage, current and/or power compared to pulse P1' or they may be identical, because pulse P2' can be independent of actuation of the actuator. High precision positioning thereby may be obtained.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A lockable microelectromechanical actuator comprising:

a microelectromechanical actuator;

a thermoplastic material that is coupled to the microelectromechanical actuator to lock the microelectromechanical actuator; and a heater that melts the thermoplastic material to allow movement of the microelectromechanical actuator.

2. A lockable microelectromechanical actuator according to claim 1 further comprising a substrate, wherein the heater is on the substrate, wherein a portion of the microelectromechanical actuator is adjacent and spaced apart from the heater and wherein the thermoplastic material is between the heater and the portion of the microelectromechanical actuator.

3. A lockable microelectromechanical actuator according to claim 2 wherein the heater melts the thermoplastic material to allow movement of the microelectromechanical actuator along the substrate.

4. A lockable microelectromechanical actuator according to claim 1 wherein the microelectromechanical actuator is a thermally actuated microelectromechanical actuator that moves in response to thermal actuation.

5. A lockable microelectromechanical actuator according to claim 4 wherein the thermally actuated microelectromechanical actuator moves in response to thermal actuation of the heater.

6. A lockable microelectromechanical actuator according to claim 4 wherein the heater is a first heater, the lockable microelectromechanical actuator further comprising a second heater that is thermally coupled to the microelectromechanical actuator such that the microelectromechanical actuator moves in response to actuation of the second heater.

7. A lockable microelectromechanical actuator according to claim 6 further comprising a thermal isolator that is configured to thermally isolate the second heater from the thermoplastic material.

8. A lockable microelectromechanical actuator according to claim 5 wherein the heater is configured to melt the thermoplastic material and actuate the thermal actuator upon application of a first amount of power thereto and is configured to melt the thermoplastic material without actuating the thermal actuator upon application of a second amount of power thereto that is less than the first amount of power.

9. A lockable microelectromechanical actuator according to claim 6 wherein the first heater is configured to melt the thermoplastic material without actuating the thermal actuator upon application of power thereto.

10. A lockable microelectromechanical actuator according to claim 1 wherein the thermoplastic material comprises at least one of a thermoplastic polymer, a thermoplastic monomer and solder.

11. A lockable microelectromechanical actuator according to claim 1 in combination with at least one of a relay contact, an optical attenuator, an optical switch, a variable circuit element, a valve and a circuit breaker that is mechanically coupled to the microelectromechanical actuator for actuation thereby.

12. A lockable thermal arched beam microelectromechanical actuator comprising:

a substrate;

spaced apart supports on the substrate;

an arched beam that extends between the spaced apart supports and that further arches upon application of heat thereto for movement along the substrate;

a thermoplastic material that is coupled to the arched beam to lock the arched beam; and a heater that melts the thermoplastic material to allow movement of the arched beam.

13. A lockable thermal arched beam microelectromechanical actuator according to claim 12 wherein the heater is on the substrate, wherein the arched beam is adjacent and spaced apart from the heater and wherein the thermoplastic material is between the heater and the arched beam.

14. A lockable thermal arched beam microelectromechanical actuator according to claim 12 wherein the arched beam further arches upon application of heat thereto by the heater.

15. A lockable thermal arched beam microelectromechanical actuator according to claim 12 wherein the heater is a first heater, the lockable thermal arched beam microelectromechanical actuator further comprising a second heater that is thermally coupled to the arched beam such that the arched beam further arches in response to the second heater.

16. A lockable thermal arched beam microelectromechanical actuator according to claim 15 further comprising a thermal isolator that is configured to thermally isolate the second heater from the thermoplastic material.

17. A lockable thermal arched beam microelectromechanical actuator according to claim 14 wherein the heater is configured to melt the thermoplastic material and further arch the arched beam upon application of a first amount of power thereto and is configured to melt the thermoplastic material without further arching the arched beam upon application of a second amount of power thereto that is less than the first amount of power.

18. A lockable thermal arched beam microelectromechanical actuator according to claim 15 wherein the first heater is configured to melt the thermoplastic material without further arching the arched beam upon application of power thereto.

19. A lockable thermal arched beam microelectromechanical actuator according to claim 12 wherein the thermoplastic material comprises at least one of a thermoplastic polymer, a thermoplastic monomer and solder.

20. A lockable thermal arched beam microelectromechanical actuator according to claim 12 in combination with at least one of a relay contact, an optical attenuator, an optical switch, a variable circuit element, a valve and a circuit breaker that is mechanically coupled to the microelectromechanical actuator for actuation thereby.

21. A lockable thermal arched beam microelectromechanical actuator according to claim 12 wherein the arched beam is a first arched beam, the thermal arched beam microelectromechanical actuator further comprising:

a second arched beam that extends parallel to the first arched beam and that also further arches upon application of heat thereto for movement along the substrate; and a coupler that is attached to the first and second arched beams such that the first and second arched beams move in tandem along the substrate upon application of heat thereto;

wherein the thermoplastic material is coupled between the coupler and the heater.

22. A lockable thermal arched beam microelectromechanical actuator according to claim 21 wherein the coupler includes an aperture that extends therethrough from opposite the heater to adjacent the heater and that is configured to allow placement of the thermoplastic material between the coupler and the heater.

23. A method of operating a microelectromechanical actuator comprising:

melting a thermoplastic material that is coupled to the microelectromechanical actuator to unlock the microelectromechanical actuator;

actuating the unlocked microelectromechanical actuator; and allowing the melted thermoplastic material to solidify to lock the microelectromechanical actuator.

24. A method according to claim 23 wherein the steps of melting and actuating are performed simultaneously.

25. A method according to claim 23:

wherein the microelectromechanical actuator includes a heater that is thermally coupled to the thermoplastic material;

wherein the melting step comprises the step of applying power to the heater to melt the thermoplastic material; and wherein the allowing step comprises the step of removing the power from the heater to allow the melted thermoplastic material to solidify.

26. A method according to claim 25:

wherein the microelectromechanical actuator is a thermally actuated microelectromechanical actuator;

wherein the heater also is thermally coupled to the thermally actuated microelectromechanical actuator; and wherein the actuating step comprises the step of applying power to the heater to actuate the thermally actuated microelectromechanical actuator.

27. A method according to claim 26 wherein the melting and actuating steps are performed simultaneously by applying power to the heater.

28. A method according to claim 23:

wherein the microelectromechanical actuator includes a first heater that is thermally coupled to the thermoplastic material;

wherein the microelectromechanical actuator is a thermally actuated microelectromechanical actuator;

wherein the microelectromechanical actuator includes a second heater that is thermally coupled to the thermally actuated microelectromechanical actuator;

wherein the melting step comprises the step of applying power to the first heater to melt the thermoplastic material;

wherein the actuating step comprises the step of applying power to the second heater to actuate the thermally actuated microelectromechanical actuator; and wherein the allowing step comprises the step of removing the power from the heater to allow the melted thermoplastic material to solidify.

29. A method according to claim 23 wherein the allowing step is followed by the step of:

again melting the thermoplastic material to again unlock the microelectromechanical actuator.

30. A method according to claim 29 wherein the again melting step comprises the step of:

again melting the thermoplastic material to unlock and deactuate the microelectromechanical actuator.

31. A method according to claim 29:

wherein the microelectromechanical actuator includes a heater that is thermally coupled to the thermoplastic material;

wherein the again melting step comprises the step of applying power to the heater to melt the thermoplastic material.

32. A method according to claim 31:

wherein the microelectromechanical actuator is a thermally actuated microelectromechanical actuator;

wherein the heater also is thermally coupled to the thermally actuated microelectromechanical actuator; and wherein the again melting step comprises the step of applying power to the heater that is sufficient to melt the thermoplastic material but is insufficient to actuate the thermally actuated microelectromechanical actuator.

33. A method according to claim 29:

wherein the microelectromechanical actuator includes a first heater that is thermally coupled to the thermoplastic material;

wherein the microelectromechanical actuator is a thermally actuated microelectromechanical actuator;

wherein the microelectromechanical actuator includes a second heater that is thermally coupled to the thermally actuated microelectromechanical actuator; and wherein the again melting step comprises the step of applying power to the first heater to melt the thermoplastic material without applying power to the second heater.

34. A method according to claim 23 further comprising the step of:

controlling at least one of a relay contact, an optical attenuator, an optical switch, a variable circuit element, a valve and a circuit breaker in response to the actuating step.

* * * * *